US006485291B2

(12) United States Patent
Adams

(10) Patent No.: US 6,485,291 B2
(45) Date of Patent: Nov. 26, 2002

(54) COVERED SPARK-GENERATING DEVICE FOR A LIGHTER WITH ENGAGEABLE MANIPULABLE MEMBER

(75) Inventor: Paul H. Adams, Monroe, CT (US)

(73) Assignee: BIC Corporation, Milford, CT (US)

( * ) Notice: Subject to any disclaimer, the term of this patent is extended or adjusted under 35 U.S.C. 154(b) by 0 days.

(21) Appl. No.: 09/757,631

(22) Filed: Jan. 11, 2001

(65) Prior Publication Data

US 2002/0090586 A1 Jul. 11, 2002

(51) Int. Cl.[7] ..... F23D 11/36; F23D 14/28; F23Q 1/02

(52) U.S. Cl. ..... 431/153; 431/277; 431/344

(58) Field of Search ..... 431/153, 277, 431/344

(56) References Cited

U.S. PATENT DOCUMENTS

| | | | | |
|---|---|---|---|---|
| 2,168,732 | A | 8/1939 | Dubsky | |
| 2,498,377 | A | 2/1950 | Nissen | |
| 3,174,309 | A | 3/1965 | Kobayashi | |
| D205,465 | S | 8/1966 | Breman | D48/27 |
| D211,822 | S | 7/1968 | Banninger | D48/27 |
| D212,382 | S | 10/1968 | Poppel | D48/27 |
| 3,439,994 | A | 4/1969 | Cassan | 431/254 |
| D216,328 | S | 12/1969 | Gujer | D48/27 |
| D217,017 | S | 3/1970 | Beijering | D48/27 |
| 3,752,637 | A | 8/1973 | Norman et al. | 431/274 |
| 3,756,766 | A | 9/1973 | Green | 431/254 |
| D229,712 | S | 12/1973 | Vogel | D48/27 R |
| 3,884,616 | A | 5/1975 | Neyret | 431/142 |
| 3,884,618 | A | 5/1975 | Neyret | 431/254 |
| 3,895,905 | A | 7/1975 | Nissen | 431/254 |
| 3,938,943 | A | 2/1976 | Malamoud | 431/150 |
| D240,303 | S | 6/1976 | Neyret | D27/42 |
| D241,556 | S | 9/1976 | Matsuo et al. | D27/42 |
| 3,994,666 | A | 11/1976 | Spinosa et al. | 431/144 |
| 4,028,043 | A | 6/1977 | Neyret | 431/144 |
| 4,049,370 | A | 9/1977 | Neyret | 431/144 |
| D247,051 | S | 1/1978 | Tricot | D27/36 |
| 4,190,412 | A | 2/1980 | Nitta | 431/151 |
| 4,416,612 | A | 11/1983 | Tabata | 431/131 |

(List continued on next page.)

FOREIGN PATENT DOCUMENTS

| | | |
|---|---|---|
| CH | 677021 A5 | 3/1991 |
| FR | 637.828 | 7/1927 |
| FR | 936.273 | 11/1946 |
| WO | WO 01/65183 | 2/2001 |
| WO | WO 01/69134 A1 | 2/2001 |

*Primary Examiner*—Henry Bennett
*Assistant Examiner*—Kathryn Ferko
(74) *Attorney, Agent, or Firm*—Pennie & Edmonds LLP

(57) ABSTRACT

A spark-generating device for a lighter that has a sparker configured and adapted to produce sparks, and preferably a cover configured and adapted to substantially prevent operational contact of the sparker by a finger of a user during actuation of the sparker, the device including at least one manipulable member configured and adapted for manipulation and movement by a user and having at least two associations with the sparker. In a first association, the manipulable member is independently movable with respect to the sparker, and in an operable association, the manipulable member is coupled with the sparker to move the sparker.

35 Claims, 9 Drawing Sheets

U.S. PATENT DOCUMENTS

| | | | | | |
|---|---|---|---|---|---|
| D272,564 | S | | 2/1984 | Racek | D27/42 |
| 4,846,667 | A | | 7/1989 | Lin | 431/151 |
| 5,017,128 | A | | 5/1991 | Hunter | 431/277 |
| 5,085,578 | A | | 2/1992 | Hunter | 431/277 |
| 5,096,414 | A | | 3/1992 | Zellweger | 431/277 |
| 5,197,870 | A | | 3/1993 | Yang | 431/153 |
| 5,271,731 | A | | 12/1993 | Hsin-Chung | 431/254 |
| 5,364,261 | A | | 11/1994 | Huang | 431/153 |
| 5,431,558 | A | | 7/1995 | McDonough et al. | 431/153 |
| 5,456,598 | A | | 10/1995 | McDonough et al. | 431/153 |
| 5,483,978 | A | * | 1/1996 | Doiron | 131/329 |
| 5,490,773 | A | | 2/1996 | Lloveras Capilla | 431/153 |
| 5,520,197 | A | * | 5/1996 | McDonough et al. | 431/153 |
| 5,597,299 | A | | 1/1997 | Jon | 431/153 |
| 5,676,537 | A | | 10/1997 | Fang | 134/153 |
| 5,735,294 | A | * | 4/1998 | McDonough et al. | 131/329 |
| 5,769,098 | A | | 6/1998 | McDonough et al. | 131/329 |
| 5,788,474 | A | | 8/1998 | Chung et al. | 431/153 |
| 5,846,069 | A | * | 12/1998 | Sher | 431/153 |
| 5,868,561 | A | * | 2/1999 | Rogelet | 431/153 |
| 5,897,307 | A | | 4/1999 | Chang | 431/153 |
| 5,957,680 | A | * | 9/1999 | Doucet et al. | 431/153 |
| 5,971,749 | A | * | 10/1999 | Chen | 431/153 |
| 5,997,281 | A | * | 12/1999 | Lei | 431/153 |
| 6,053,727 | A | * | 4/2000 | Potskhishvili et al. | 431/153 |
| 6,074,198 | A | * | 6/2000 | Rogelet | 431/153 |
| 6,099,296 | A | * | 8/2000 | Wang | 431/153 |
| 6,099,298 | A | * | 8/2000 | Potskhishvili et al. | 431/153 |
| 6,123,541 | A | * | 9/2000 | Yang | 431/153 |
| 6,146,128 | A | * | 11/2000 | Feng et al. | 431/153 |

* cited by examiner

COVERED SPARK-GENERATING DEVICE FOR A LIGHTER WITH ENGAGEABLE MANIPULABLE MEMBER

FIELD OF THE INVENTION

The present invention relates to lighters which resist undesired operation by unintended users.

BACKGROUND OF THE INVENTION

Lighters have been developed to resist undesired operation by unintended users. Some efforts have included hindering the unintended user'ability to produce sparks or otherwise ignite lighter fuel. For example, U.S. Pat. Nos. 5,483,978; 5,520,197; and 5,769,098 disclose lighters with a resiliently deformable guard that covers a striking wheel assembly. To operate such lighters, a user may exert sufficient pressure to depress the guard before rotating the striking wheel assembly. The pulp of a user'finger also may wrap around the guard to rotate the strike wheel assembly.

Other lighters that rely on hindering an unintended user'ability to produce sparks include U.S. Pat. Nos. 5,096,414 and 5,547,370 and PCT Publication No. WO 98/04869. These references disclose lighters with which the pulp of the thumb of the intended user, such as an adult, can be used to rotate the striker wheel located between two plates that are freely rotatable with respect to the striker wheel.

Other teachings are directed to preventing the release of fuel from the lighter. Examples of these teachings include U.S. Pat. Nos. 5,165,886; 5,125,829; 5,090,893; 5,002,482; and PCT Publication No. WO 93/17282.

SUMMARY OF THE INVENTION

The invention is directed to a spark generating device or a lighter using a spark generating device for igniting fuel, which is preferably configured for use in disposable cigarette lighters and which more preferably resists inadvertent operation or makes undesired operation by unintended users more difficult.

In one embodiment, the spark generating device generally includes a sparker, which is preferably non-piezoelectric and preferably includes a striker drum. The sparker or striker drum may contact a flint to generate sparks, which when configured in a lighter ignites released fuel.

The spark generating device may include a manipulable member which has an exposed portion which is arranged for manipulation and movement by a user. The manipulable member is configured to have at least two associations with the sparker; a first disengaged association in which the manipulable member is independently movable, and preferably freely rotatable, with respect to the sparker, and a second operable association in which the manipulable member moves, and preferably rotates, the sparker to generate sparks.

In the preferred embodiment of the invention, a clutch releasably connects the manipulable member to the sparker between the first disengaged condition and the second engaged condition. In the preferred clutch, the manipulable member includes a first clutch portion and the sparker includes a second clutch portion. The first and second clutch portions move between a first position where they are disengaged and move independently of one another, and a second position w here they are frictionally connected so they move together. The first and second clutch portions preferably have engageable surfaces configured for engaging with each other in the engaged, operable condition to transfer motion.

The manipulable member remains in a disengaged first condition unless at least a sufficient coupling force is applied to the manipulable member to place the clutch in the engaged condition. The coupling force which is sufficient to place the clutch in the engaged condition preferably is difficult for unintended users to apply in order to provide increased resistance to operation by such users.

In a preferred embodiment, the manipulable member comprises two wheels, and a striker drum is arranged between the two wheels on a common axis. The manipulable member may be arranged and configured to have a greater height than the sparker, and preferably the striker drum.

The spark generating device also preferably includes a cover or guard member configured to substantially prevent contact of the sparker, and preferably the striker drum, by the user during actuation of the sparker. The cover or guard member is preferably disposed adjacent the sparker. The cover or guard member may be positioned radially outward of, even with, or inward of the manipulable member. The cover or guard member may be disposed radially outward of the manipulable member in a manner to inhibit manipulation of the manipulable member as an alternative or further method of providing increased resistance to unintended operation. The guard may be resiliently deformable, preferably so when configured to be disposed outward of the manipulable member, so that application of a predetermined inward force on the guard may move the guard to a position to permit manipulation of the manipulable member. The force required to move or deform the guard to permit manipulation of the manipulable member may be configured to provide increased difficulty of operation to resist undesired operation by unintended users. The guard may further be substantially rigid, and may be configured to be positioned radially outward of, even with, or inward of the manipulable member. Where the guard is rigid it may further be configured to make manipulation of the manipulable member more difficult in order to resist undesired operation of the lighter by unintended users.

The manipulable member is preferably disposed adjacent, and preferably above, the finger actuatable portion of the valve actuator to permit operation of both the manipulable member and the finger actuatable portion of the valve actuator by moving a finger along a path or paths that is generally in contact with the lighter. The cover or guard member may be configured and disposed to cover the sparker generally along the path or paths in order to substantially decrease manipulation of the sparker upon movement of the finger along this path.

DETAILED DESCRIPTION OF THE PREFERRED EMBODIMENTS

Figure 1:
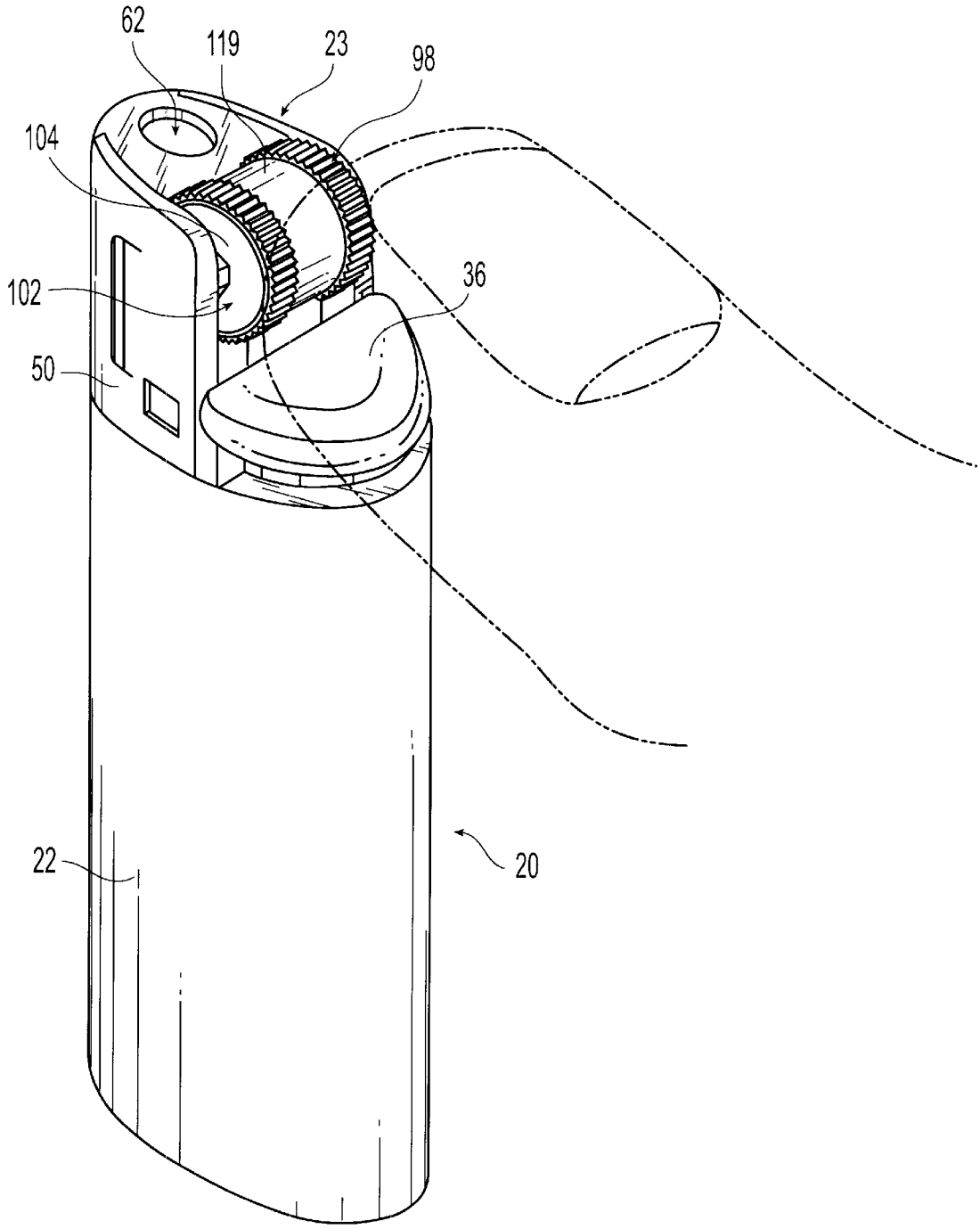
FIG. 1 is a perspective view of an embodiment of a lighter constructed according to the invention.
Figure 2:
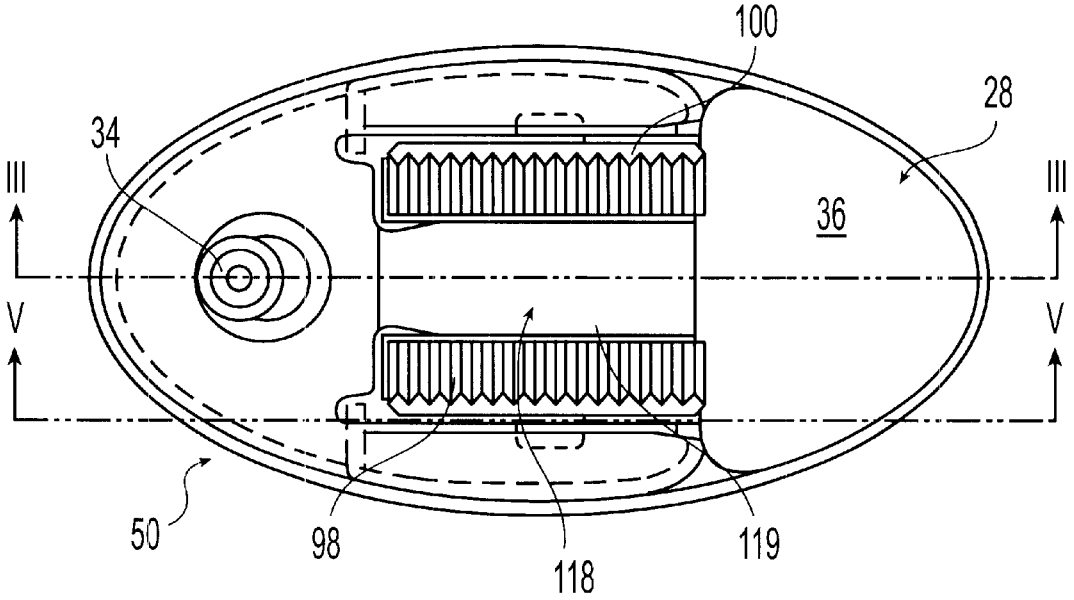
FIG. 2 is a top view of the lighter of FIG. 1.

Referring to FIGS. 1—4, lighter 20 has a body 22 with a sparking assembly 23 mounted thereon. A valve actuator 28 is pivotally mounted to the body 22 below the sparking assembly by tabs 30. The valve actuator has a slot 32 through which valve 34 extends on one side of tabs 30 and a thumb pad 36 on the other side of the tabs 30. Near the middle region of the valve actuator 28 is an opening 37 through which flint 24 extends to contact the sparking assembly 23.

Valve 34 controls the release of fuel 41 from the reservoir 42. In a preferred embodiment, valve 34 is moved towards an open valve position by the pressure of the fuel in the reservoir 42. Compression spring 44 pushes up on the side of the valve actuator 28 that has thumb pad 36 forcing the valve actuator to act downwardly in order to keep the valve closed. A second compression spring 38 may act between the valve actuator and the valve 34 to prevent the release of fuel before the thumb pad is sufficiently depressed. Depressing the thumb pad 36 with sufficient valve actuation force allows the valve actuator 28 and valve 34 to move upwardly to release fuel. An alternative embodiment employs a normally closed valve that is forced open by the valve actuator when the thumb pad 36 is depressed.

The sparking assembly 23 preferably includes a non-piezoelectric sparker, and more preferably a roll and press type of sparker 94. The sparking assembly 23 of this embodiment has an axle 90 rotatably mounted between supports 92. Sparker 94 preferably includes a striker drum 96 coupled to the axle 90, preferably fixedly connected to prevent relative rotation between the axle 90 and the striker drum 96. In this embodiment, a helically wound toothed metallic wire 95 is disposed on striker drum 96 to contact the flint 24 and generate the spark, although other mechanisms and textures may be used. Flint 24 is forced into frictional contact with the sparker 94, and preferably the toothed wire 95 on striker drum 96, by spring 26. The striker drum 96 and the flint 24 are associated such that rotation of the striker drum 96 with sufficient speed and in a proper direction, and preferably the toothed wire 95, against the flint 24 produces sparks directed at the stream of fuel selectively released from the valve 34. Other mechanisms and textures may be used to frictionally contact the flint to provide sparks. For example, the striker drum itself may be textured so that as it rotates against the flint and produces sparks.

Lighter 20 has a manipulable member 98, preferably including at least one manually rotatable turning-wheel 100, and preferably two turning wheels 100, which are exposed to the exterior of the lighter 20 for turning by a user in order to rotate the striker drum 96 against the flint. The striker drum 96 is preferably adjacent to the manipulable member 98 and in this embodiment is preferably disposed between the two turning wheels 100. In this embodiment, the wheels 100 also may be disposed about axle 90 between supports 92. The turning wheels have an outer surface 101 to increase traction or friction of a finger of a user to assist turning them. This outer surface 101 is preferably serrated or knurled, although it may be smooth. The height of the turning wheels 100 may be greater than the striker drum 96.

Figure 5:
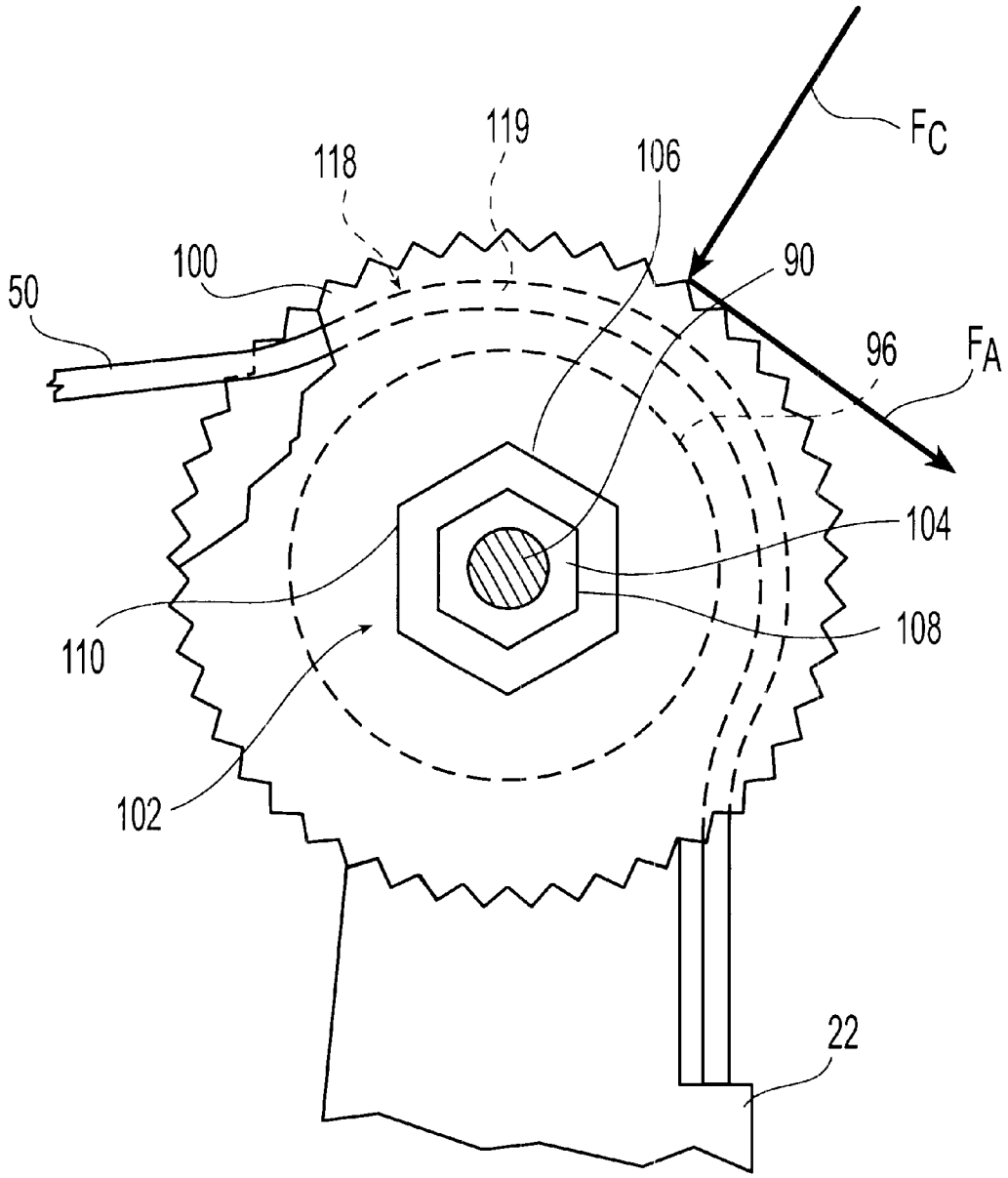
FIG. 5 is a cross-sectional side view thereof taken along line V—V, shown in FIG. 2.

The turning wheels 100 are preferably connected to the striker drum 96 through a clutch 102, as shown in FIG. 5. The clutch 102 permits turning wheels 100 to rotate, preferably substantially freely, without rotating striker drum 96 unless sufficient radial force is applied to turning wheels 100. Preferably, clutch 102 includes an outer clutch member 106, which may be an inner portion of the turning wheels 100.

Alternatively, the outer clutch member 106 may be a separate member fixed to and drivably connected with the turning wheels 100. Preferably, clutch 102 may also include an inner clutch member 104 which may be an outer portion of the axle 90. Alternatively, the inner clutch member 104 may include a separate member fixed to and coupled with axle 90.

The inner and outer clutch members 104,106 have engageable surfaces 108,110 respectively for engaging with each other, although in an alternative embodiment, an additional member or members may be disposed between the inner and outer clutch members, providing a clutch with a higher number of parts that can be disengaged and engaged with each other to operate the spark generating device. The surfaces 108,110 engage each other for coupled rotation upon application of sufficient radial force against the turning wheels 100. The surfaces preferably slip against each other when a radial force of less than a predetermined minimum coupling force is applied to turning wheels 100. When the inner and outer clutch members 104,106 do not engage, the turning wheels 100 are independently rotatable with respect to the axle 90, and the striker drum 96. When the inner and outer clutch members 104,106 are in this disengaged position, the manipulable member 98 is disconnected from the sparker 94, providing a disengaged association between the manipulable member 98 and the sparker 94.

If a sufficient minimum radial coupling force is applied to the turning wheels 100, clutch surface 108 engages clutch surface 110 such that rotation of the turning wheels 100 causes the rotation of the axle 90 and operation of the sparker 94. Sufficient radial force applied to the turning wheels thus allows a tangential actuation force on the turning wheels 100 to rotate the axle 90 and striker drum 96 to produce a spark. When less than the minimum radial coupling force is applied, or when the radial force is released, the clutch 102 naturally assumes the disengaged condition so that sparks in this condition will not be produced.

Figure 6:
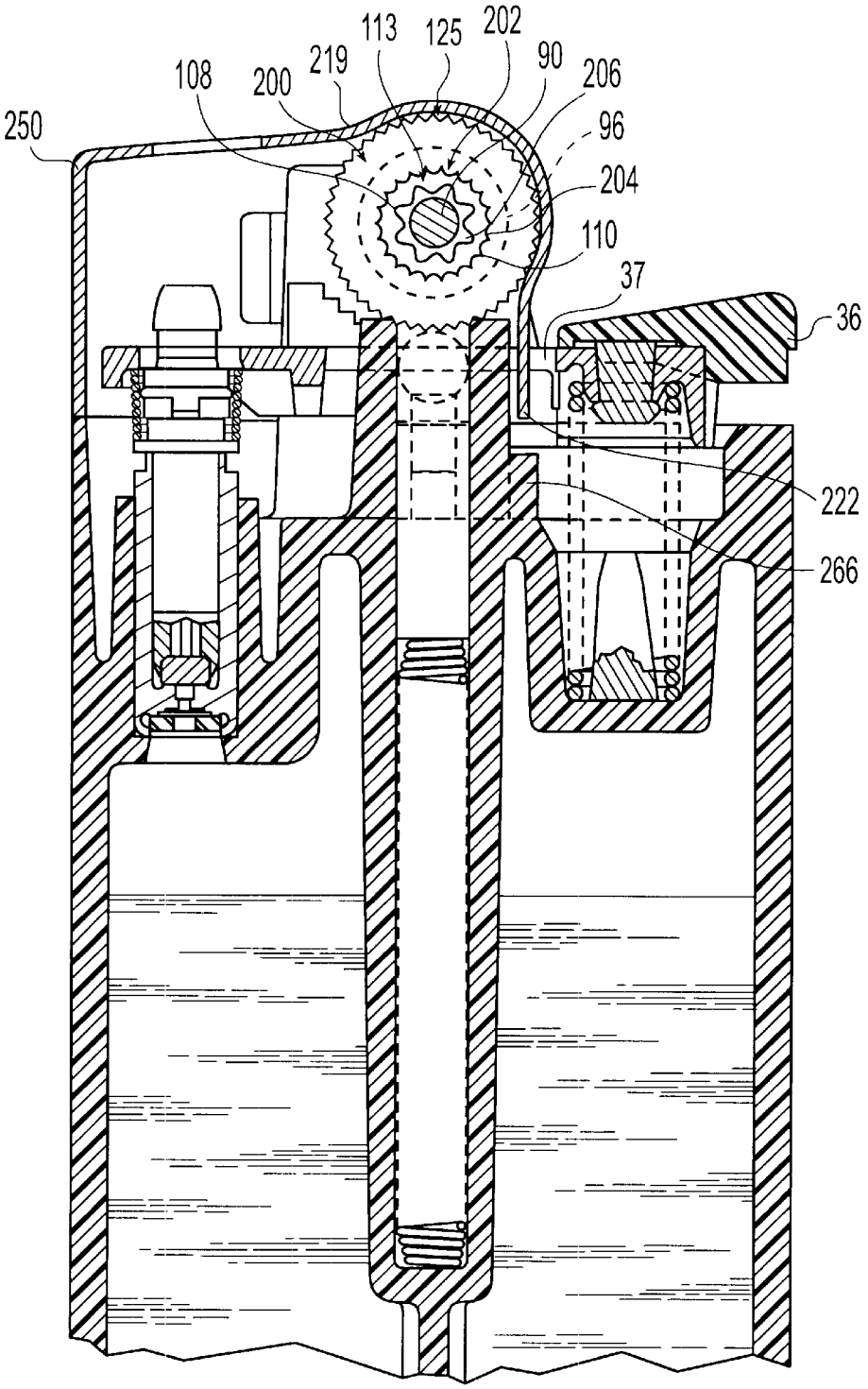
FIG. 6 is a cross-sectional side view showing an alternative embodiment of a clutch and cover.

Referring to FIGS. 5 and 6, clutches 102,202 are preferably friction clutches in which the inner and outer clutch members are frictionally connected in the engaged condition to allow the turning wheels to operate the sparker 94. In FIG. 5, the inner and outer clutch members 104,106 preferably have polygonal profiles configured to engage each other in order to transfer rotational force from the turning wheels 100 to the axle 90. Clutch 202 in FIG. 6 preferably includes inner and outer clutch members 204,206 with knurled profiles and may be shaped, for example, with star shaped profiles or as daisy wheels. The inner and outer clutch members 204,206 are preferably configured to engage each other for coupled rotation upon application of the sufficient radial coupling force against the turning wheels 200. These knurled profiles are configured to slip against each other when a radial force of less than the sufficient minimum coupling force is applied to the turning wheels 200. Other embodiments of the inner and outer clutch members may employ textured surfaces, selected shapes or selected materials for engaging the inner and outer clutch members. In a further embodiment, an additional member or material, such as a viscous material, may be placed between the turning wheels and the sparker or axle, such that application of sufficient radial force against the turning wheels when rotating the turning wheels will also rotate the striker drum. Yet other embodiments may use different forms of clutches to allow the turning wheels or other manipulable member to spin freely from the sparker until the clutch is engaged, and may employ such structures as disclosed in PCT Publication No. WO 98/04869.

The direction of the coupling force necessary to engage the clutch $F_C$ as shown in FIG. 5 is at an angle to the direction of the actuation force necessary to move the manipulable member to operate the sparker $F_A$.

In order to provide increased resistance to inadvertent operation of the sparker 94 or undesired operation by unintended users, the lighter preferably has a cover or guard that sufficiently covers or protects the sparker 94 to substantially prevent or at least significantly inhibit direct manipulation of the sparker 94 by a user during actuation of the lighter. The cover or guard member may cover sparker 94 less than completely so that a portion of the sparker can remain exposed or accessible, however the cover or guard preferably covers the sparker 94 sufficiently to keep a user from directly contacting the sparker drum 96 with a finger, at least during movements to actuate the lighter.

Figure 3:
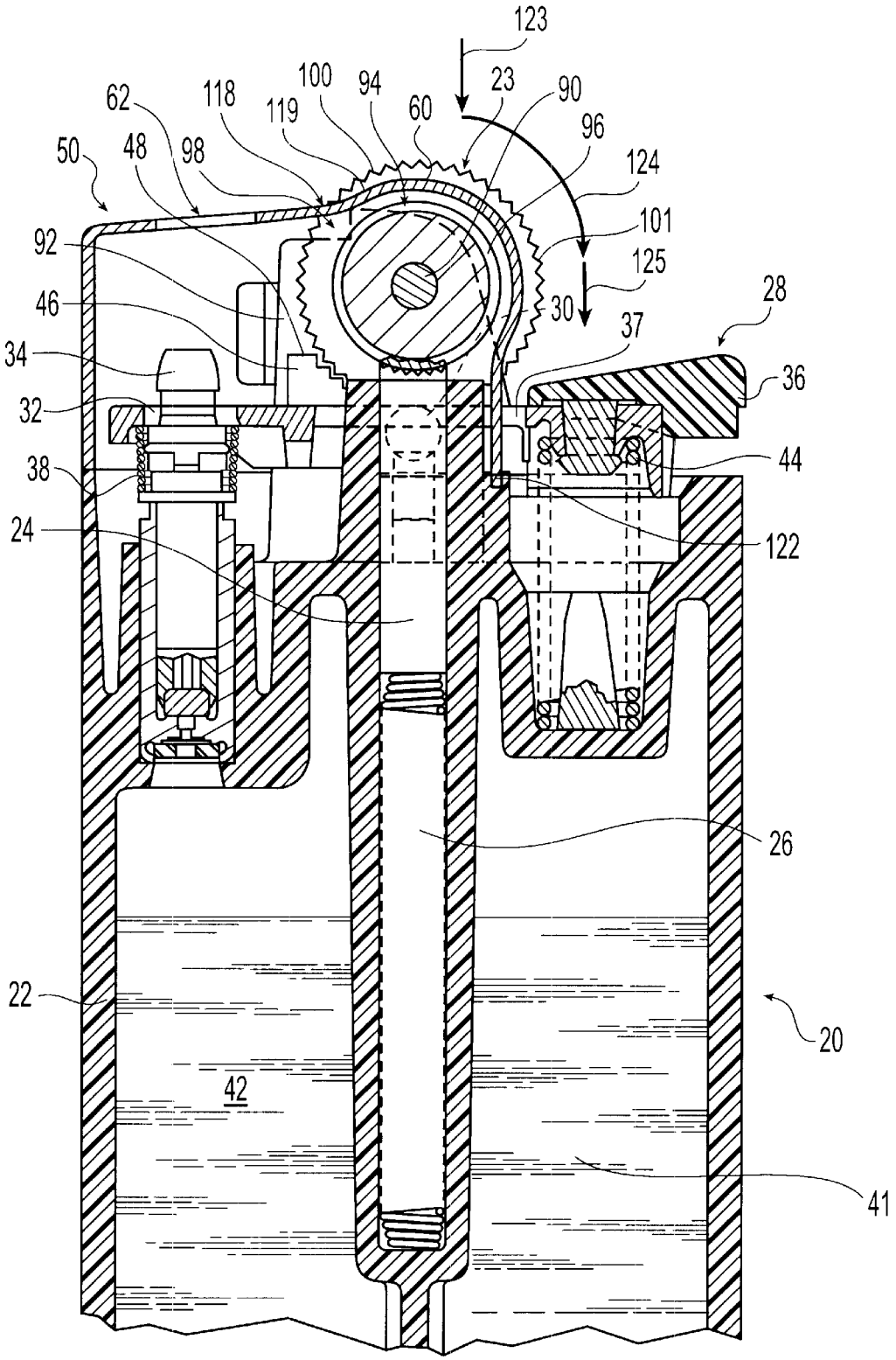
FIG. 3 is a cross-sectional side view thereof taken along line Ill—III, shown in FIG. 2.
Figure 4:
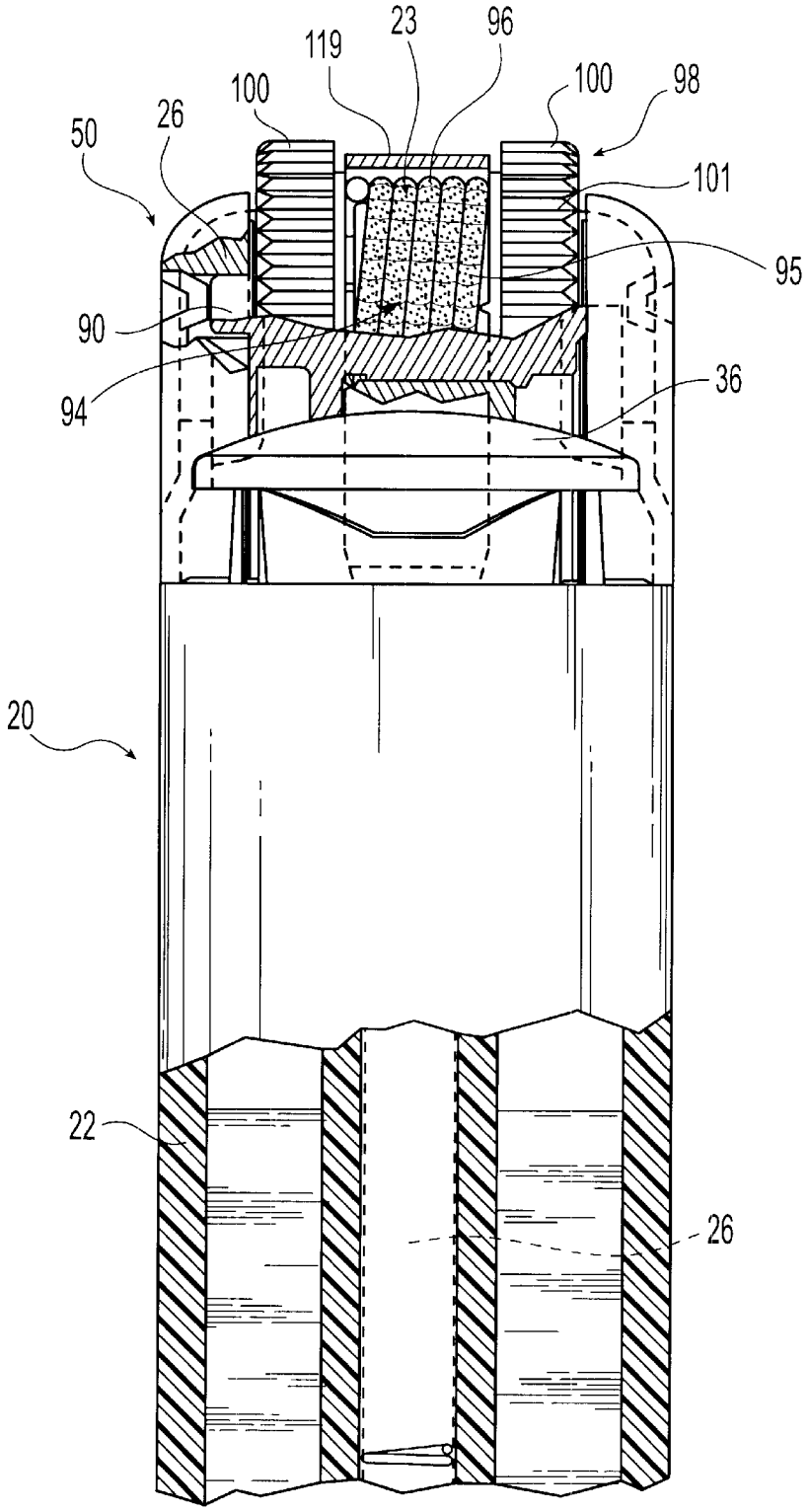
FIG. 4 is a partial cross-sectional rear view of the lighter of FIG. 1.

The manipulable member 98 is preferably disposed adjacent the finger-actuatable thumb pad 36 to permit operation of both the manipulable member 98, including the turning wheels 100, and the valve actuator 28 by moving a finger along a path that preferably includes separate path segments 123–125 (see FIG. 3). Namely, a user first moves his finger downward along path segment 123 in order to apply sufficient radial force on the manipulable member so that the clutch will engage, then the user moves his finger along path segment 124, preferably pressing the turning wheels 100 and rotating the manipulable members with sufficient speed and in a proper direction, and then moves his finger downward along path segment 125 with sufficient force to move the valve actuator 28.

In a preferred embodiment, the turning wheels 100 are exposed for manipulation substantially adjacent to and on opposite sides of the cover 118. The cover 118 may include a guard 119, which is preferably arcuately shaped, and preferably extends sufficiently over and around at least a portion of the striker drum 96 of the sparker 94 to prevent turning of the striker drum 96 directly with a finger. Thus, the preferred guard 119 covers the sparker 94 at least generally along path 124 for substantially preventing direct manipulation of the sparker 94 upon movement of the finger along the path 124. The guard 119 may leave portions of the sparker 94 uncovered that are not located along the path 124.

In this regard, the cover or guard is preferably located to cover at least the portion of the sparker that is adjacent the part of the manipulable member normally manipulated to create a spark. The guard 119 preferably covers at least the portion of the sparker 94 that is above and adjacent the thumb pad 36 because in normal usage the manipulable member 98 is moved with the thumb or other finger which immediately thereafter can depress the thumb pad 36.

Guard 119 preferably has an end 122 attached directly to the body 22 and is positioned around and substantially covers the striker drum 96 to substantially prevent direct manipulation of the striker drum 96. In FIG. 3, guard 119 is disposed inside of the outer perimeter of the turning wheels 100 when viewed along the axis of the axle 90. The guard 119 can alternatively be disposed substantially at, above, or below of the outer periphery of the turning wheels 100. Guard 119 in the lighter of FIG. 3 is not required to deform for a user to operate the sparking assembly and thus may be substantially rigid or flexible.

The cover 118 in FIG. 3 also includes a wind shield 50, which covers a forward portion of the striker drum 96 that is not covered by the guard 119. The wind shield 50 is mounted to the lighter body 22 and defines a flame orifice 62 disposed above the valve 34 for the flame of the ignited fuel. In an alternative embodiment, the guard may be of separate construction from the wind shield and may be mounted directly to the lighter body.

Referring to the embodiment of FIG. 6, guard 219 is disposed radially outwardly from turning wheels 200, but preferably does not cover or fully extend over the wheels, leaving them accessible to a user. The distance that the guard 219 extends radially beyond turning wheels 200 is preferably sufficient to inhibit manipulation of the turning wheels 200. The guard 219 is preferably resiliently deformable by an inward application of at least a predetermined guard force to a position that permits manipulation of the turning wheels 200 by the intended user. By extending the guard 219 radially beyond the turning wheels the lighter may be configured to be more difficult to operate by unintended users.

To operate the lighter of FIG. 6, a user applies an inward force to the guard 219 to resiliently deflect the guard 219 to a point at which the user'finger can contact the turning wheels 200. The force required to operate this embodiment is of a magnitude to sufficiently deflect the guard 219 and additionally to engage the clutch 202. Thus, the guard 219 may increase the force required to operate the lighter over that required by the clutch 202 alone.

Figure 7:
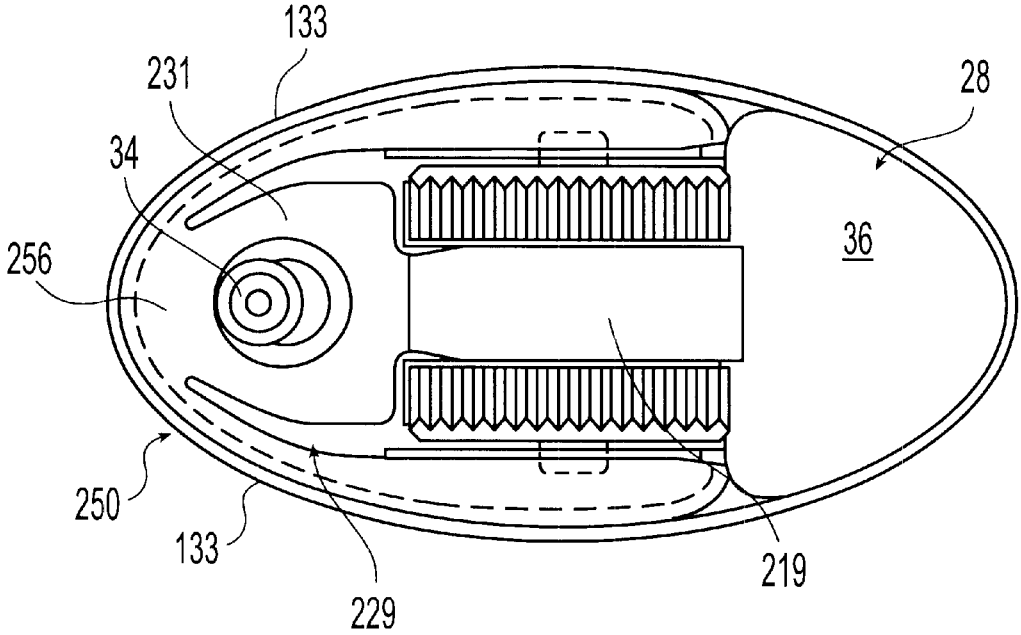
FIG. 7 is a top view of the lighter of FIG. 6.

As shown in FIGS. 6 and 7, guard 219 is fixed to windshield 250 and extends through opening 37 of the valve actuator 28 and terminates at end 222 disposed above a stop 266, which limits the deflection of the guard 219. As shown in FIG. 7, windshield 250 preferably has cutouts 129 on both sides of top portion 231 of the windshield 250 and is disconnected from the vertical walls 133 of the windshield 250 adjacent these cutouts 129. The guard 219 of this embodiment thus bends principally about a neck section 256. The guard 219 is preferably made of 1050 C.R. steel and has a thickness of about 0.5 mm such that some of the deformation of the guard 219 can occur in the arcuate portion of the guard 219 itself, in addition to the neck 256.

In a different embodiment the guard may protrude radially outside, substantially at or below the periphery of the turning wheels as shown in FIG. 6, but be comparatively stiff and substantially rigid and resistant to significant deformation from a finger during actuation of the turning wheels. The height of the guard above the turning wheels 200 in this embodiment should be small enough that the pulp of the intended user'finger can bend around the guard and apply at least the minimum radial coupling force to engage the clutch and rotate the turning wheels.

Figure 9:
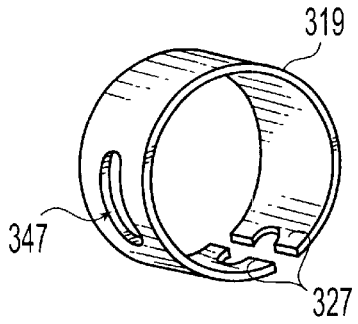
FIG. 9 is a perspective view of a guard of the lighter of FIG. 8.
Figure 8:
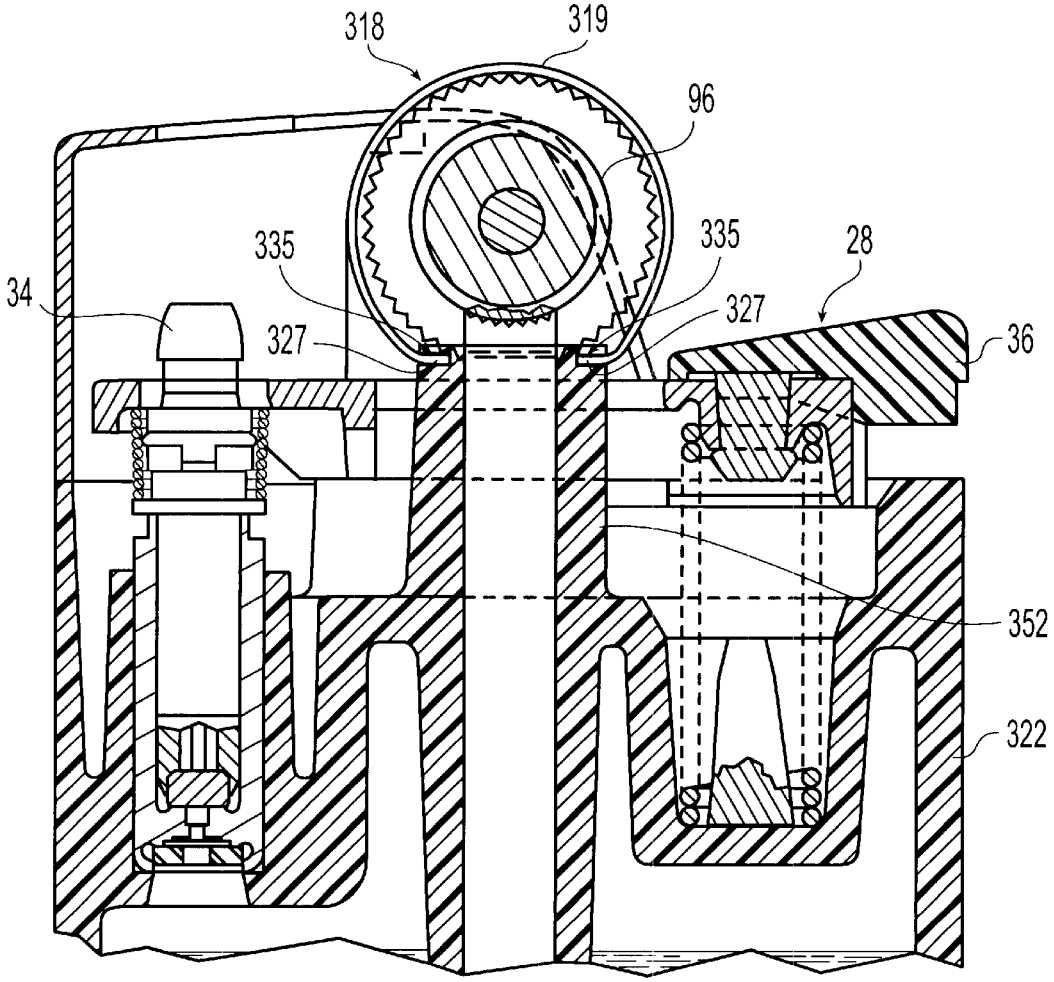
FIG. 8 is a cross-sectional side view of an alternative embodiment of a lighter.

Referring to FIG. 8, an alternative embodiment of the lighter has a cover 318 with a band shaped guard 319 (shown in FIG. 9) that extends most of the way around the striker drum 96. The guard of this embodiment can be configured as the guards disclosed in U.S. Pat. No. 5,769,098, the contents of which are incorporated by reference herein. The guard 319 is resiliently mounted to the lighter body 322, preferably as a clamp, with ends 327 of the guard 319 received in notches 335 of boss 352 of the body 322. As shown in FIG. 9, the guard 319 defines a spark orifice 347 configured and positioned to allow sparks to pass through the spark orifice 347 to the fuel released from the valve 34.

Figure 11:
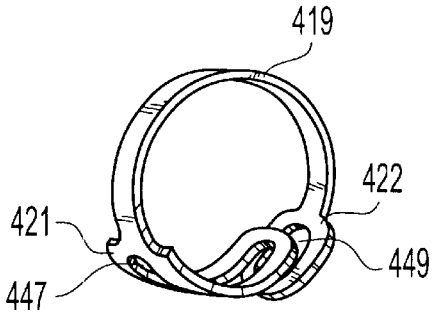
FIG. 11 is a perspective view of a guard of the lighter of FIG. 10.
Figure 10:
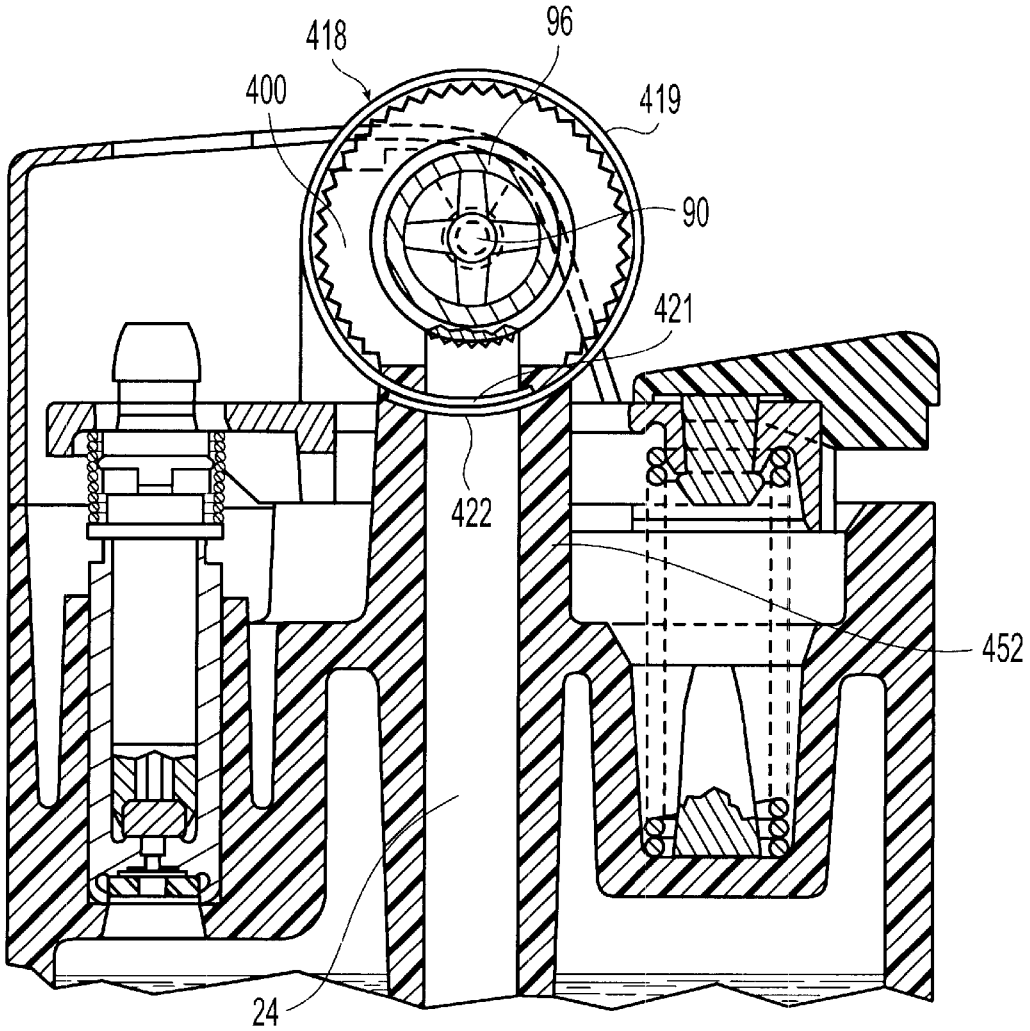
FIG. 10 is a cross-sectional side view of another embodiment of a lighter.

The embodiment of FIGS. 10 and 11 has a guard 419 of a cover 418 that is looped completely around striker drum 96. Ends 421,422 of the guard 419 are overlapped in the assembled lighter. Guard end 421 defines a spark orifice 447, which is preferably elongated to receive flint 24 and to allow sparks to pass through the spark orifice 447 towards fuel released from the valve. Guard end 422 defines a flint receiving opening 449, which is preferably at least partially overlapped with the spark orifice 447 and also receives the flint 24. The spark orifice 447 and the flint receiving opening also preferably receive part of boss 452. Guard 419 preferably extends outwardly with respect to turning wheels 400 and preferably is resiliently deformable to access the turning wheels 400 and operate the lighter. The guard may alternatively be located below or inwardly from the periphery of the turning wheels 400 and alternatively may also be substantially rigid.

The force required and the dexterity needed to rotate the striker drum 96 can be controlled by varying the configurations of the elements that increase the difficulty of operation for unintended users. For example, the lighter can be made more difficult to operate by increasing the stiffness or the height of the guard, or requiring a higher coupling force for the clutch to function. Preferably, the degree of difficulty of use for each of these mechanisms is selected so that the combination of the mechanisms maximizes the user friendliness of the spark generating device, while retaining an adequate level of difficulty of use, most preferably to maximize the difficulty of use for the unintended user. For example, the level of difficulty to operate the guard may be increased in a lighter that has a clutch that is easy to operate, and vice versa. The total resultant force required to rotate the striker drum is at least the sum of any force required to overcome the guard, the force required to engage the clutch mechanism, and the force required to overcome the friction between the striker drum and the flint.

Referring again to FIG. 3, the preferred embodiment of the lighter 20 includes at least one brake member 46 with at least one tooth 48 facing the turning wheels 100. The brake members preferably are mounted on the valve actuator 28 and configured to engage the turning wheels 100 to stop the rotation of the turning wheels 100 when the valve actuator 28 is depressed. Preferably, the teeth 48 engage the knurls on the turning wheels 100 when the thumb pad 36 of the valve actuator 28 is depressed. In this manner, the turning wheels 100 are prevented from rotating once the thumb pad 36 is depressed sufficiently. This further inhibits and makes generation of a flame more difficult by an unintended user. Alternatively, the brake members 46 have a different surface structure, such as a flat or concave gripping material, to catch and stop the rotation of the turning wheels 100. Yet another embodiment has a brake member that engages a portion of the sparking assembly that is fixed to the striker drum or engages the striker drum itself to stop the rotation of the striker drum.

Preferably the forces necessary to be applied to the manipulable member, or the manipulable member and the guard, including the other child resistant mechanisms that may be employed, are difficult to be operated by an unintended user. The lighter is preferably configured so that an unintended user does not have the strength, physical characteristics, dexterity, or cognitive ability to easily rotate the sparker to create a spark.

The invention described and claimed herein is not to be limited in scope by the specific embodiments herein disclosed, since these embodiments are intended solely as illustrations of several aspects of the invention. Any equivalent embodiments are intended to be within the scope of this invention. Indeed, various modifications of the invention in addition to those shown and described herein will become apparent to those skilled in the art from the foregoing description. For example, alternative manipulable members may be employed which are not turning wheels and which may move along paths that are not rotational, such as a linear path. Such modifications are also intended to fall within the scope of the appended claims.

What is claimed:

1. A spark-generating device, comprising:

a sparker configured and adapted to produce sparks;

a cover configured and adapted to substantially prevent operational contact of the sparker by a user during actuation of the sparker; and at least one manipulable member configured and adapted for manipulation and movement by a user;

wherein the manipulable member has at least two associations with the sparker, including a first association in which the manipulable member is movable with respect to the sparker, and an operable association in which the manipulable member moves the sparker.

2. The spark-generating device of claim 1, further comprising a clutch mechanism that releasably couples the manipulable member to the sparker.

3. The spark-generating device of claim 1, wherein the at least one manipulable member is rotatable to operate the sparker in the operable association with the sparker.

4. The spark-generating device of claim 1, wherein the cover comprises a guard disposed radially outwardly of the manipulable member.

5. The spark generating device of claim 4, wherein the distance by which the guard is disposed radially outwardly of the manipulable member is sufficient to inhibit manipulation of the at least one manipulable member, the guard being resiliently deformable by an inward application of at least a predetermined guard force to permit manipulation of the at least one manipulable member.

6. The spark-generating device of claim 4, wherein the at least one manipulable member comprises a manually rotatable wheel disposed substantially adjacent the guard.

7. The spark-generating device of claim 1, wherein the cover is disposed radially at or inwardly of the at least one manipulable member and around at least a portion of the sparker.

8. The spark-generating device of claim 1, wherein the at least one manipulable member is configured such that biasing of the manipulable member with at least a predetermined coupling force places the at least one manipulable member in operable association with the sparker.

9. The spark-generating device of claim 8, wherein the at least one manipulable member is configured for operating the sparker upon movement in an actuation direction, and the coupling force is directed at an angle to the actuation direction.

10. The spark-generating device of claim 9, wherein the at least one manipulable member is rotatable for operating the sparker, and the coupling force is directed substantially radially.

11. The spark-generating device of claim 1, wherein the sparker comprises a striker drum.

12. The spark-generating device of claim 1, wherein the at least one manipulable member is movable substantially independently from the sparker in the first association with the sparker.

13. The spark-generating device of claim 1, wherein the cover is configured for covering substantially the entire sparker sufficiently to substantially prevent direct manipulation of the sparker with a finger.

14. A spark-generating device for a lighter, comprising:

a sparker configured and adapted to produce sparks for igniting fuel;

a cover configured and adapted to substantially prevent operational contact of the sparker by a user during actuation of the sparker;

at least one manipulable member exposed for manipulation and movement by a user; and a clutch having at least two conditions, including a first condition whereby the manipulable member is movable independently of the sparker, and an engaged condition whereby the manipulable member is operably connected to the sparker;

wherein manipulation of the at least one manipulable member in the engaged condition allows operation of the sparker to produce sparks.

15. The spark-generating device of claim 14, wherein the clutch comprises a portion of the manipulable member.

16. The spark-generating device of claim 14, wherein the clutch comprises a friction clutch.

17. The spark-generating device of claim 16, wherein the clutch comprises a first clutch member fixedly connected to the at least one manipulable member, and a second clutch member fixedly connected to the sparker, wherein the first and second clutch members are disengaged in the first condition and frictionally connected in the engaged condition.

18. The spark-generating device of claim 16, wherein the clutch comprises a first clutch member fixedly connected to the at least one manipulable member, and a second clutch member fixedly connected to the sparker, wherein the first and second clutch members comprise engageable surfaces with profiles configured for engaging with each other in the engaged condition.

19. The spark-generating device of claim 16, wherein the at least one manipulable member and the clutch are associated such that applying at least a predetermined coupling force on the manipulable member places the clutch in the engaged condition.

20. The spark-generating device of claim 19, wherein the clutch is in the first condition unless a predetermined coupling force is applied to at least one manipulable member.

21. The spark-generating device of claim 15, wherein the at least one manipulable member is exposed for manipulation adjacent the cover.

22. A lighter, comprising:

a lighter body containing a fuel supply and an outlet to release the fuel;

a sparker comprising a striker drum mounted to the body and operable to produce sparks directed towards the released fuel;

at least one turning wheel disposed for manipulation and movement by a user, the striker drum disposed adjacent to the at least one turning wheel;

a cover portion configured and adapted to prevent operational contact of the sparker by a user during actuation of the sparker; and a clutch configured for:

operatively connecting the at least one turning wheel with the sparker upon application of a coupling force to the turning wheel to operate the sparker, and disconnecting the at least one turning wheel from the sparker upon application of less than the coupling force turning wheel.

23. The lighter of claim 22, further comprising:

a valve for controlling release of the fuel from the outlet; and a valve actuator for operating the valve and having a finger actuatable portion;

wherein the at least one turning wheel is disposed adjacent the finger actuatable portion to permit operation of the at least one turning wheel and the finger actuatable portion by moving a finger along a path generally in contact with the lighter, and wherein the cover is disposed and configured to substantially prevent direct manipulation of the sparker upon movement of the finger along the path.

24. The lighter of claim 22, wherein the at least one turning wheel comprises two turning wheels, and the striker drum is disposed between the two turning wheels.

25. A spark-generating device for a lighter, comprising:

a sparker comprising a striker drum configured and adapted to produce sparks;

a cover having an arcuate shape configured and adapted to substantially prevent operational contact of the sparker by a user during actuation of the sparker by substantially covering the sparker;

two turning wheels disposed for manipulation and movement by a user, the sparker disposed between the two turning wheels; and a clutch having a first engageable surface associated with the sparker and a second engageable surface associated with at least one turning wheel such that upon application of a sufficient force to at least one turning wheel, the second engageable surface engages the first engageable surface.

26. The spark-generating device of claim 25, wherein the first engageable surface is disposed on the sparker and the second engageable surface is disposed on at least one turning wheel.

27. The spark-generating device of claim 25, further comprising an axle disposed through the sparker and the two turning wheels.

28. The spark-generating device of claim 27, wherein the sparker is fixedly attached to the axle.

29. The spark-generating device of claim 28, wherein the first engageable surface is disposed on the axle and the second engageable surface is disposed on at least one turning wheel.

30. The spark-generating device of claim 27, wherein the sparker can rotate with respect to the axle.

31. The spark-generating device of claim 25, wherein the sparker has two projections, each projection extending from an end of the sparker and the first engageable surface is disposed on at least one of the projections.

32. The spark-generating device of claim 27 wherein each turning wheel has a hole configured and adapted to receive the axle therethrough.

33. The spark-generating device of claim 31 wherein each turning wheel has a hole configured and adapted to receive one of the projections therethrough.

34. The spark-generating device of claim 32 wherein the axle and the holes are different shapes.

35. The spark-generating device of claim 33 wherein the projections and the holes are different shapes.

* * * * *